US007494160B2

(12) United States Patent
Lin et al.

(10) Patent No.: US 7,494,160 B2
(45) Date of Patent: Feb. 24, 2009

(54) SEALING STRUCTURE OF HEAT PIPE AND METHOD FOR MANUFACTURING THE SAME

(75) Inventors: Cheng-Hui Lin, Tu-Cheng (TW); Jing-Hao Li, Shenzhen (CN); Wei Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 335 days.

(21) Appl. No.: 11/309,069

(22) Filed: Jun. 15, 2006

(65) Prior Publication Data

US 2007/0290505 A1 Dec. 20, 2007

(51) Int. Cl.
*F16L 13/14* (2006.01)

(52) U.S. Cl. ..... 285/382; 29/890.032; 29/890.053

(58) Field of Classification Search ..... 285/382, 285/288.1, 286.1; 29/890.032, 890.053, 29/890.06

See application file for complete search history.

(56) References Cited

U.S. PATENT DOCUMENTS

| | | | | |
|---|---|---|---|---|
| 3,292,414 | A * | 12/1966 | Goeke | 29/890.053 |
| 3,680,189 | A * | 8/1972 | Noren | 29/890.032 |
| 6,463,911 | B1 * | 10/2002 | Treusch et al. | 29/890.053 |
| 6,568,370 | B1 * | 5/2003 | Treusch et al. | 123/467 |
| 6,871,635 | B2 * | 3/2005 | Curran et al. | 123/456 |
| 6,957,691 | B2 * | 10/2005 | Hsieh | 165/104.26 |
| 7,073,257 | B1 * | 7/2006 | Hsu | 29/890.032 |
| 7,192,064 | B2 * | 3/2007 | Hsu | 285/382 |
| 7,229,104 | B2 * | 6/2007 | Hsu | 285/382 |
| 2005/0051259 | A1 * | 3/2005 | Luo | 156/198 |
| 2005/0167984 | A1 | 8/2005 | Hsu | |

FOREIGN PATENT DOCUMENTS

| | | |
|---|---|---|
| CN | 1517662 | 8/2004 |
| CN | 2677852 | 2/2005 |
| CN | 2708222 | 7/2005 |

* cited by examiner

*Primary Examiner*—David E Bochna
(74) *Attorney, Agent, or Firm*—Frank R. Niranjan

(57) ABSTRACT

A sealing structure formed at an end of a heat pipe, includes a two-layer structure, which can be divided into two walls and a rib interconnecting the walls together, wherein the rib points to a center of the heat pipe. A method for manufacturing the sealing structure includes following steps: (1) providing a metallic pipe with an end sealed and an opposite open portion; (2) pressing the open portion of the pipe to form the two-layer sealing structure by using a pair of pressing molds, wherein the pair of pressing molds comprises a first pressing mold and a second pressing mold, the first mold having an M-shaped convex portion, the second mold having an M-shaped concave portion corresponding to the convex portion.

11 Claims, 10 Drawing Sheets

SEALING STRUCTURE OF HEAT PIPE AND METHOD FOR MANUFACTURING THE SAME

FIELD OF THE INVENTION

The present invention relates to a sealing structure of a heat pipe, and more particularly to a method for manufacturing the same.

DESCRIPTION OF RELATED ART

Today, heat pipes are among the chief instruments used to keep electronic components such as central processing units (CPUs) working within a tolerable range of temperature. A heat pipe usually includes a cylindrical body with a cavity defined therein and a quantity of working fluid contained in the cavity. The heat pipes transfer heat originating at the CPUs away through phase transition of the working fluid, and the cavities inside the pipes are vacuum-exhausted to form a vacuum thus making the working fluid easy to evaporate. The more perfect the vacuum in the heat pipe, the lower the temperature at which the heat pipe begins to work. Thus, it is necessary for the heat pipe to be hermetically sealed after being vacuum-exhausted. A sealing structure is formed to hermetically seal the heat pipe. The sealing structure of the heat pipe is one of key factors in determining quality and performance of the heat pipe. Many researchers in this area are looking for a method for manufacturing a sealing structure, which may keep the pressure in the heat pipe within a certain range.

A conventional sealing structure 12 of a heat pipe 10 is shown in FIG. 10 wherein it has a semi-circular cross section. The conventional sealing structure 12 is consisted of two layers of transformative metal; the metal has resilience and trends to resile (i.e. return to its previous form), which may adversely affect the bonding strength between the two layers of the conventional sealing structure 12. Thus, the conventional sealing structure 12 is not reliable and may form a leak particularly when the heat pipe is subjected to a high temperature with the working fluid therein being evaporated into vapor having a high pressure.

What is needed, therefore, is a sealing structure for a heat pipe and a method for manufacturing the same, which can overcome the above-described disadvantage of the prior art.

SUMMARY OF THE INVENTION

A sealing structure formed at an end of a heat pipe, comprises a two-layer structure, which can be divided into two walls and a rib interconnecting the walls together, wherein the rib extends between the two walls. A method for manufacturing the sealing structure comprises following steps: (1) providing a metallic pipe with an end sealed and an opposite open portion; (2) pressing the open portion of the pipe to form the two-layered sealing structure by using a pair of pressing molds, wherein the pair of pressing molds comprises a first pressing mold and a second pressing mold, the first mold having an M-shaped convex portion and the second mold having a corresponding M-shaped concave portion for receiving the convex portion.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE INVENTION

Figure 1:
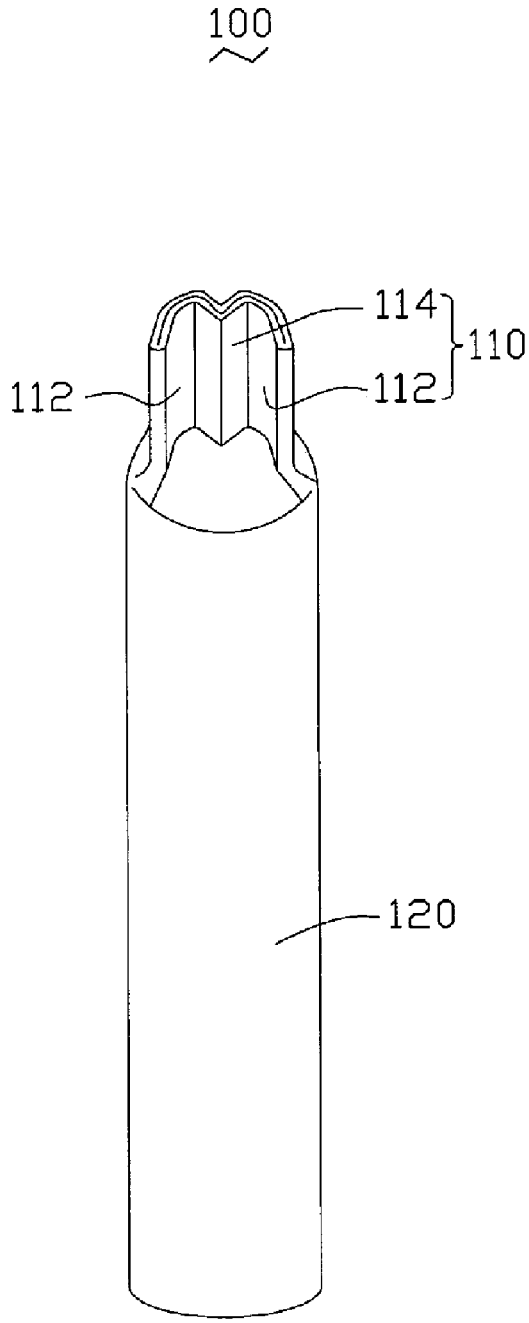
FIG. 1 is a perspective view of a heat pipe with a sealing structure in accordance with a preferred embodiment of the present invention.
Figure 2:
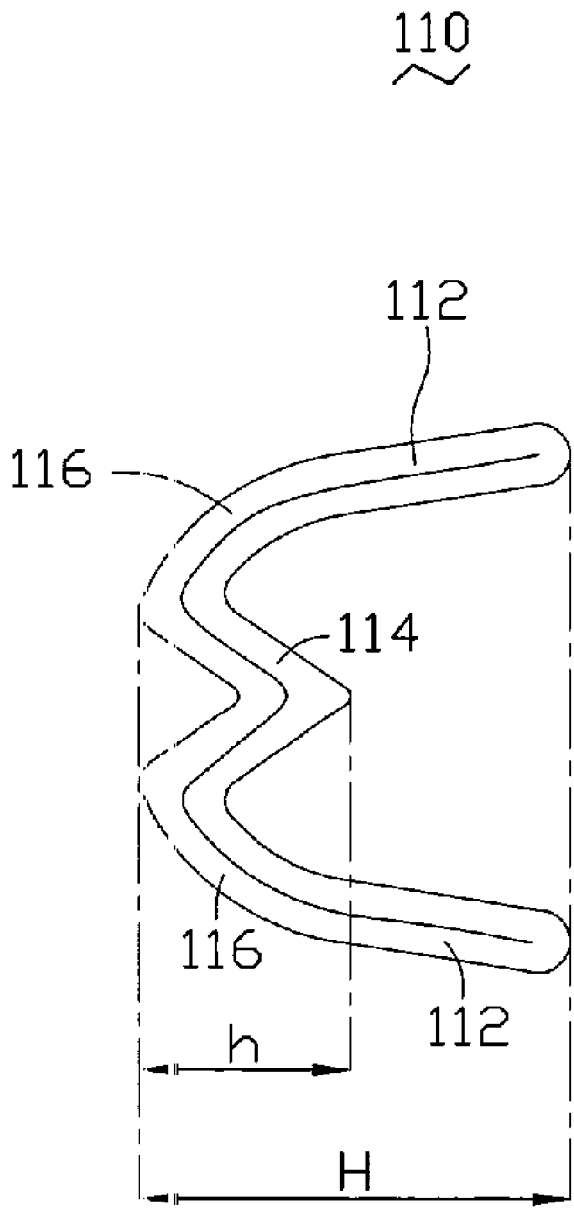
FIG. 2 is an enlarged top view of the sealing structure of the heat pipe of FIG.1.

Referring to FIGS. 1-2, a heat pipe 100 with a sealing structure 110 in accordance with a preferred embodiment of the present invention is illustrated. The heat pipe 100 comprises a metallic body 120, and the sealing structure 110 is formed at an end of the body 120. The sealing structure 110 is of two layers structure with a substantially M-shaped cross section. A top view of the sealing structure 110 illustrating it with an M-shaped structure is shown in FIG. 2. The sealing structure 110 can be divides into three parts, which are two substantially parallel walls 112 and a rib 114 interconnecting the two walls 112.

The two walls 112 are bent slightly inwards towards to each other, and each has a larger length H than a length h of the rib 114. The walls 112 comprise two transitional portions 116 connecting the walls 112 to ends of the rib 114. Each transitional portion 116 has an arc-shaped figuration, preferably with a streamlined outer figuration to reduce stress concentration caused by deformation of a pipe for forming the sealing structure 110. The rib 114 protrudes forwards from a middle part of the sealing structure 110 and is used to increase the bonding strength of the two layers of the sealing structure 110.

A method for manufacturing the sealing structure 110 comprises the following steps.

Figure 3:
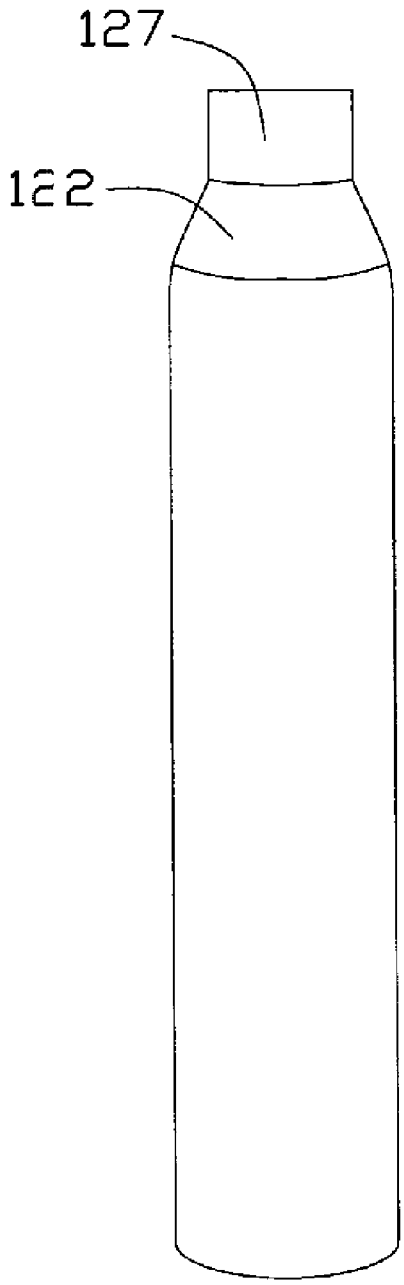
FIG. 3 is a side view of a pipe prepared for manufacturing the heat pipe.
Figure 4:
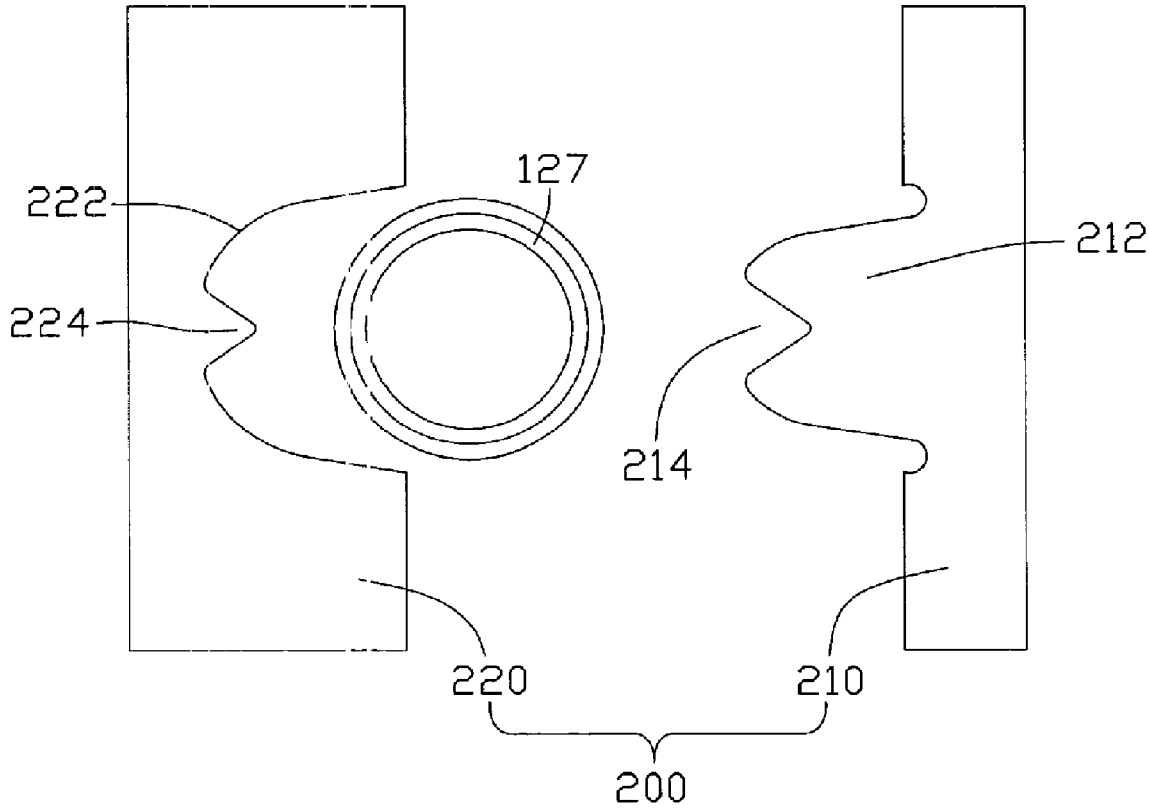
FIG. 4 is a top plan view of the pipe prior to pressing an open end portion thereof by means of a pair of pressing molds.
Figure 5:
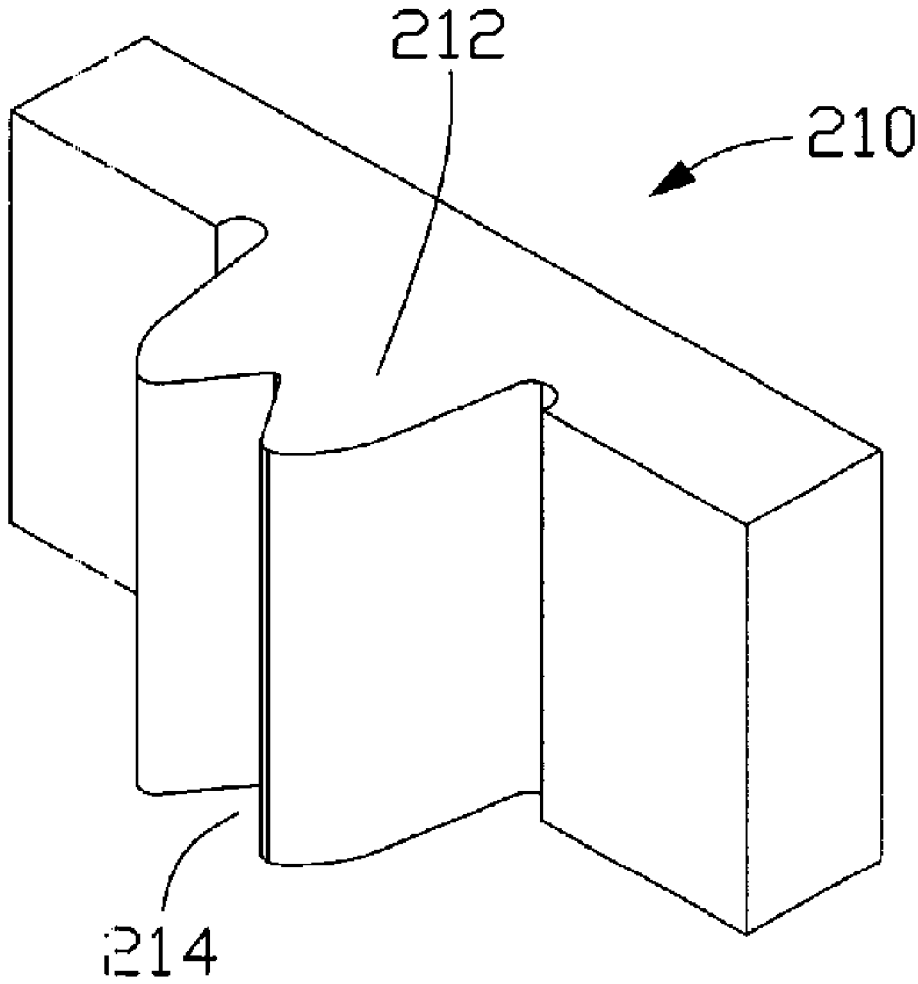
FIG. 5 is a perspective view of a first pressing mold of FIG. 4.
Figure 6:
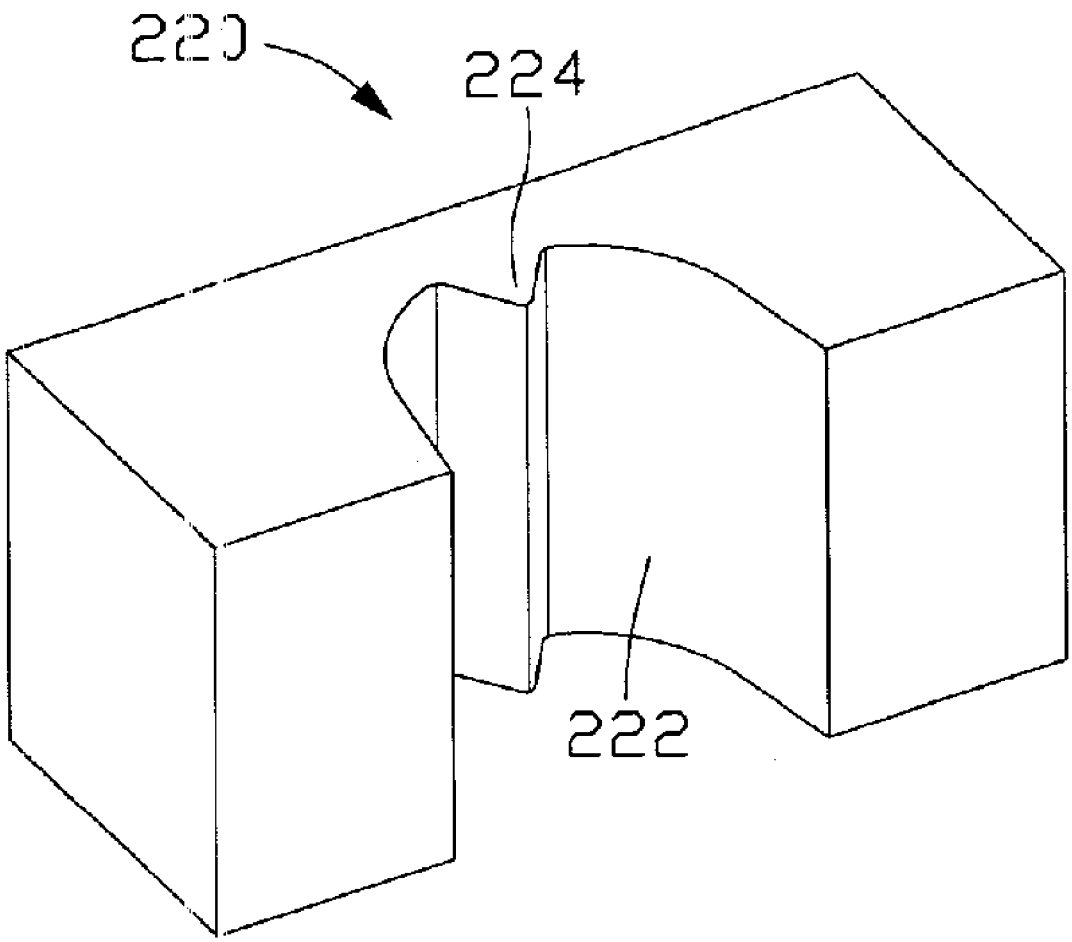
FIG. 6 is a perspective view of a second pressing mold of FIG. 4.
Figure 7:
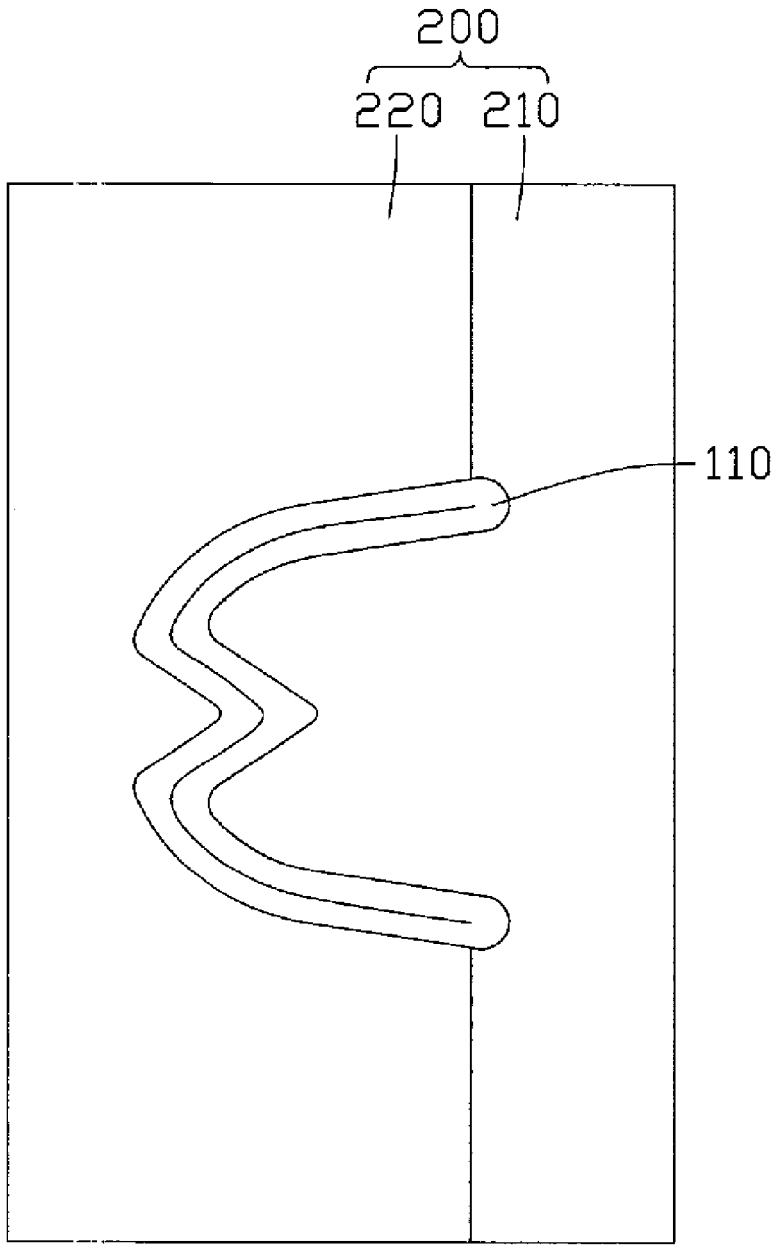
FIG. 7 is a top plan view of the pipe, illustrating the pressing of the open end portion of the pipe by the pressing molds to form the sealing structure.

Step (1) Providing a metallic pipe with a bottom end sealed and a top open portion 127 as shown in FIG. 3. Preferably, a shrinkage portion 122 is formed by a shrinking operation and joints the pipe and the top open portion 127 together.

Step (2) Transversely pressing the top open portion 127 of the pipe to form the sealing structure 110, which has an M-shaped cross section and a tip of the rib 114 extending in coincidence with a center of the pipe.

As shown in FIGS. 4-7, the top open portion 127 of the pipe is disposed in a pair of press molds 200, which includes a first mold 210 and a second mold 220.

The first mold 210 has a substantially convex projection 212 with a depressed portion 214 in form of a groove defined in a middle part thereof. Thus, the first mold 210 has a substantially M-shaped convex contacting surface. The second mold 220 has a concave portion 222 with a small protrusion 224 projected outwardly from a middle part thereof. Thus, the second mold 220 has a substantially M-shaped concave contacting surface. The depressed portion 214 and the protrusion 224 are in line with each other. The depressed portion 214 has a depth shorter than a height of the convex portion 212, and the protrusion 224 has a lower height in comparison with a depth of the concave portion 222. This can prevent the open end 127 from having a severe deformation during the pressing operation thereof, thereby to reduce the stress concentration thereat.

Therefore, the top open portion 127 of the vertically extending pipe is placed between the first mold 210 and the second mold 220 in such a manner that the protrusion 224 of the second mold 220 points to a center of the pipe and a bottom of the depressed portion 214. The first mold 210 is then moved towards the second mold 220, whereby a wall of the top open portion 127 of the pipe is cramped toward the concave portion 222 and the protrusions 224. The top open portion 127 of the pipe is pressed into a double-layered M-shaped structure with the rib 114 extending from a middle part thereof. After this step (2), the top open portion 127 of the pipe is initially closed.

Then the sealing structure 110 can be further processed by a welding step to melt an outer, top part of the sealing structure 110 to seal a slit between the two layers of the sealing structure 110, thereby assuring more perfect vacuum in the heat pipes 100.

As shown in FIGS. 1-2, the rib 114 is a continuous body without presence of irregularities or discontinuities in a form such as holes, shoulders, grooves, etc.. Thus, the rib significantly increases the bonding strength of the sealing structure 110.

Figure 10:
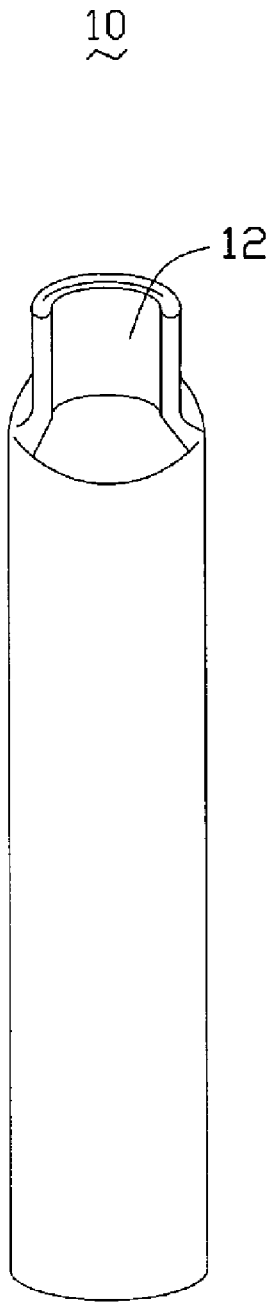
FIG. 10 (RELATED ART)
FIG. 10 is a perspective view of a conventional sealing structure of a heat pipe.

The sealing structure 110 of the preferred embodiment of the present invention and the conventional sealing structure 12 (shown in FIG. 10) with a semi-circular cross section are tested for comparing the bonding strength between the two layers of the sealing structures 110, 12. The results are shown in table 1, in which the fail includes expansions or cracks formed at the sealing structures mainly due to the high pressure built up by the vaporized working fluid.

TABLE 1

| Diameter of The Heat pipe | Kinds of Sealing Structure | Examples | Treating conditions: Temperature (° C.)/Time (min) 250/60 | 300/10 | 320/10 | 350/10 | 400/10 |
|---|---|---|---|---|---|---|---|
| ϕ6 mm | Conventional | 1 | OK | OK | Fail | — | — |
| | | 2 | OK | OK | Fail | — | — |
| | | 3 | OK | OK | Fail | — | — |
| | | 4 | OK | OK | OK | Fail | — |
| | | 5 | OK | OK | Fail | — | — |
| | | 6 | OK | OK | Fail | — | — |
| | | 7 | OK | OK | OK | Fail | — |
| | | 8 | OK | OK | OK | Fail | — |
| | | 9 | OK | OK | Fail | — | — |
| | | 10 | OK | OK | Fail | — | — |
| | The present invention | 1 | OK | OK | OK | OK | OK |
| | | 2 | OK | OK | OK | OK | OK |
| | | 3 | OK | OK | OK | OK | OK |
| | | 4 | OK | OK | OK | OK | OK |
| | | 5 | OK | OK | OK | OK | OK |
| | | 6 | OK | OK | OK | OK | OK |
| | | 7 | OK | OK | OK | OK | OK |
| | | 8 | OK | OK | OK | OK | OK |
| | | 9 | OK | OK | OK | Fail | — |
| | | 11 | OK | OK | OK | OK | OK |
| | | 13 | OK | OK | OK | OK | OK |
| | | 14 | OK | OK | OK | OK | OK |

Table 1 reveals that the heat pipe 100 in accordance with the preferred embodiment of the present invention provides a sealing structure 110 having better bonging strength than the conventional sealing structure 12 and therefore assures more perfect vacuum in the heat pipe 100.

Figure 8:
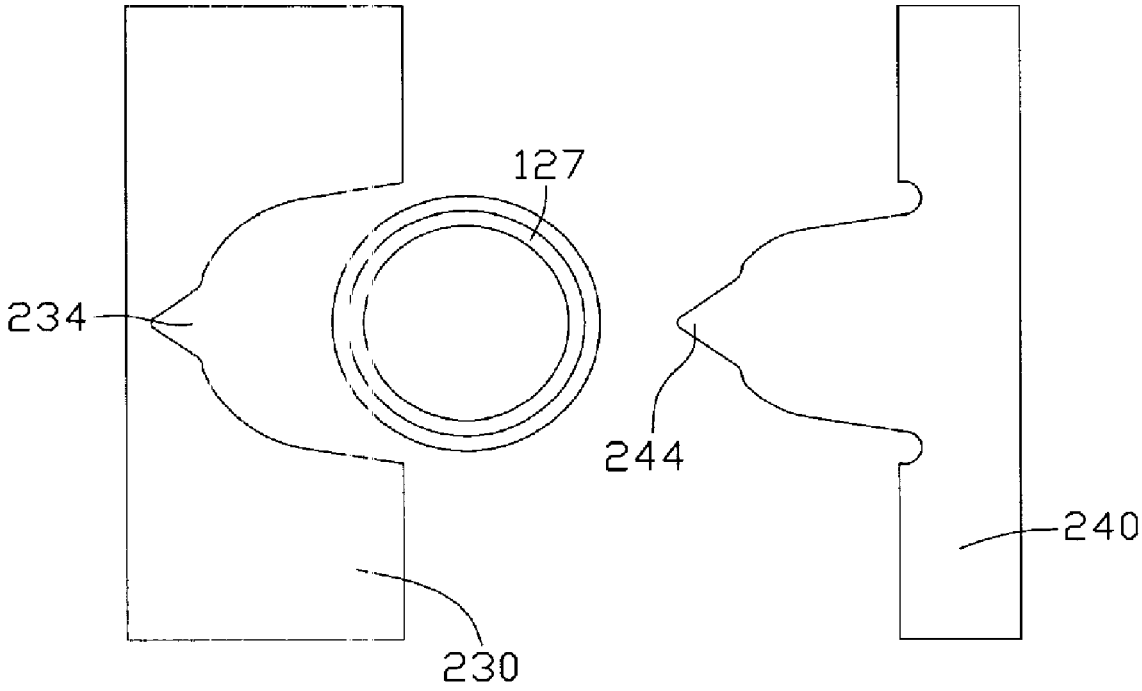
FIG. 8 is a top plan view of the pipe prior to pressing an open end portion thereof by means of another pair of pressing molds.
Figure 9:
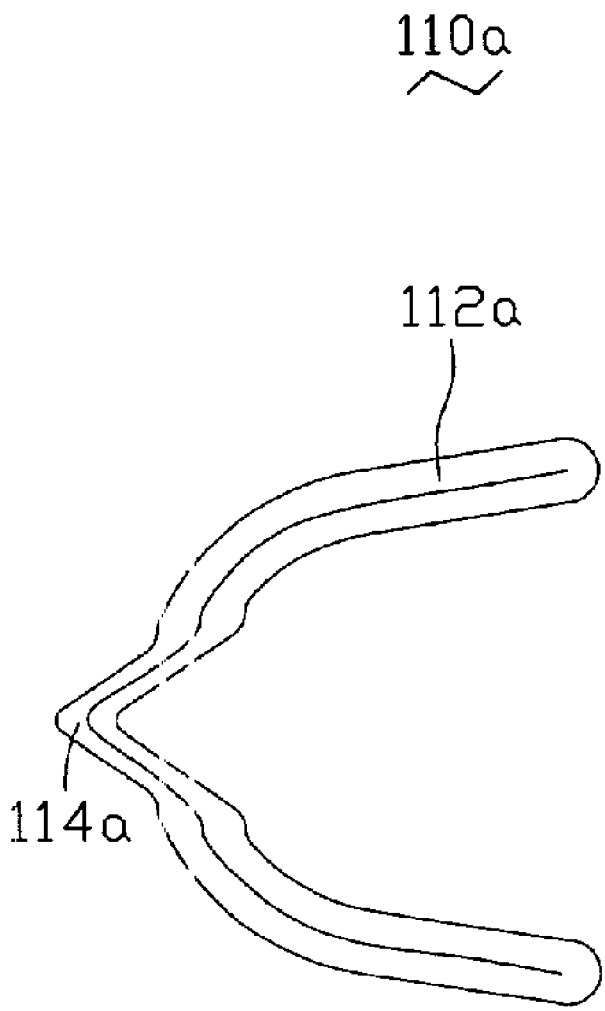
FIG. 9 is an enlarged top view of a sealing structure formed by the pressing molds of FIG. 8.

As described above, the presence of the rib 114 can efficiently increase the bonding strength between the two layers of the sealing structure 110. In the preferred embodiment, the rib 114 projects forward from the sealing structure 110 along a same direction to that of the two walls 120. For another embodiment, a rib may projects outward from a sealing structure in a direction opposite to that of the two walls. As shown in FIGS. 8-9, when the first mold 230 in a form of a substantially concave contacting surface with a depressed portion 234 defined therein, the second mold 240 in a form of a substantially convex contacting surface with a small protrusion 244 extending outward therefrom, a sealing structure 110*a* with a rib 114*a* projecting along a direction opposite to that of the two walls 112*a* is formed. Thus, the sealing structure 110*a* has a substantially semi-circular cross section with a projection extending outward from a middle part thereof.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A sealing structure formed at an end of a heat pipe, comprising a two-layer structure, which can be divided into two substantially parallel walls and a rib interconnecting the walls together, wherein the rib is located at a middle of the sealing structure and protrudes from the two walls, wherein the rib extends toward a direction opposite to that the two walls extend toward, and wherein the two walls are spaced a distance from each other.

2. The sealing structure as claimed in claim 1, wherein the rib is a continuous body.

3. The sealing structure as claimed in claim 1, wherein the two walls are bent inwards toward to each other.

4. The sealing structure as claimed in claim 3, wherein each of the walls has a length larger than that of the rib.

5. The sealing structure as claimed in claim 1, wherein the sealing structure has a substantially semi-circular cross section with the rib extending outward.

6. A method for sealing a heat pipe, comprising the steps of:

providing a metallic pipe with an end sealed and an opposite open portion; and pressing the open portion of the pipe to form a sealing structure sealing the open portion, the sealing structure having a two-layer structure, the pressing being performed by using a pair of pressing molds, wherein the pair of pressing molds comprises a first pressing mold and a second pressing mold, the second mold having a protrusion pointing to a center of the open portion of the pipe, the first mold having a depressed portion to receive and interact with the protrusion to form a rib of the sealing structure, the rib extending from a middle of the sealing structure and reinforcing the sealing structure, wherein the first mold has a substantially convex portion with the depressed portion defined in a middle part thereof, the second mold has a concave portion with the protrusion projected outwardly from a middle part thereof.

7. The method as claimed in claim 6, wherein the first pressing mold has an M-shaped convex contacting surface, and the second pressing mold has an M-shaped concave contacting surface.

8. The method as claimed in claim 6, wherein the depressed portion has a depth shorter than a height of the convex portion, and the protrusion has a lower height in comparison with a depth of the concave portion.

9. The method as claimed in claim 6 further comprising a step after the pressing step: welding an outer, top end of the sealing structure to seal a slit between the two-layer structure.

10. The method as claimed in claim 9, wherein the welding is performed by melting the outer, top end of the sealing structure.

11. A method for sealing a heat pipe, comprising the steps of:

providing a metallic pipe with an end sealed and an opposite open portion; and pressing the open portion of the pipe to form a sealing structure sealing the open portion, the sealing structure having a two-layer structure, the pressing being performed by using a pair of pressing molds, wherein the pair of pressing molds comprises a first pressing mold and a second pressing mold, the second mold having a protrusion pointing to a center of the open portion of the pipe, the first mold having a depressed portion to receive and interact with the protrusion to form a rib of the sealing structure, the rib extending from a middle of the sealing structure and reinforcing the sealing structure, wherein the first pressing mold has a substantially concave contacting surface with the depressed portion defined therein, and the second pressing mold has a substantially convex contacting surface with the protrusion extending outwardly therefrom.

* * * * *